US008424224B2

(12) United States Patent
Hampton

(10) Patent No.: US 8,424,224 B2
(45) Date of Patent: Apr. 23, 2013

(54) SHOE HEEL COVER

(76) Inventor: Heather Hampton, New Orleans, LA (US)

( * ) Notice: Subject to any disclaimer, the term of this patent is extended or adjusted under 35 U.S.C. 154(b) by 532 days.

(21) Appl. No.: 12/658,212

(22) Filed: Feb. 4, 2010

(65) Prior Publication Data

US 2011/0185601 A1 Aug. 4, 2011

(51) Int. Cl.
*A43B 13/22* (2006.01)

(52) U.S. Cl.
USPC ..... 36/72 B

(58) Field of Classification Search ..... 36/72 B, 36/35 A, 42, 34 B
See application file for complete search history.

(56) References Cited

U.S. PATENT DOCUMENTS 1,875,806 A 9/1932 Givens
2,263,186 A * 11/1941 Parkhurst ..... 36/42
2,875,534 A 3/1959 Grossman
2,977,691 A * 4/1961 Brown et al. ..... 36/7.3
D192,208 S * 2/1962 Ray et al. ..... D2/915
3,122,848 A * 3/1964 Grossman ..... 36/7.3
3,439,435 A * 4/1969 Fredon ..... 36/7 R
5,311,675 A 5/1994 Topel
2006/0196082 A1 9/2006 Robbins
2008/0196279 A1 8/2008 Epping
2009/0165337 A1 * 7/2009 Cohen et al. ..... 36/136
2009/0282702 A1 11/2009 Brown et al.

* cited by examiner

*Primary Examiner* — Ted Kavanaugh
(74) *Attorney, Agent, or Firm* — Keaty Law Firm, LLC

(57) ABSTRACT

A shoe heel cover is designed to be selectively positioned and removed from a heel of a shoe. The heel cover is configured as a resilient flexible compressible hollow body having a plurality of concave indentations formed in its outer wall. A plurality of concave parts, each corresponding to the concave indentations extends inwardly toward the center of the opening formed in the hollow body. In one aspect, the heel cover body has an hour-glass cross-section. The middle portion of the body has the smallest diameter opening, such that the convex parts exert a bias and gripping action on the heel, preventing the heel cover from slipping from the shoe heel.

16 Claims, 5 Drawing Sheets

SHOE HEEL COVER

BACKGROUND OF THE INVENTION

This invention relates generally to shoes with heels and more specifically to a cover for protecting the heel of a woman's shoe, as well as protecting wood floors from high impact of narrow heels.

The heels on most women's footwear are generally made of hard plastic or wooden blocks called "heel blocks" to which various materials, such as for instance leather, suede, and fabric are applied. The thin soft heel materials are often merely glued to heel blocks, are very fragile, and tend to damage easily. The damage may be caused by such events as catching the back of the heel on a curb, escalator, or leg of a chair; driving a car; walking down the stairs; etc. The most destructive form of damage often occurs when the heel slips into the crack or grate of a sidewalk.

Additionally, the bottom portions of the heels, the so-called "top lifts" are prone to serious damage and wear when the shoes are worn outside. The top lifts are often made of hard plastic or rubber that is a material that wears down relatively quickly. The worn down top lifts should be replaced to protect the heel cover and the heel block.

Further, narrow heels, such as stiletto heels having small top lifts, tend to damage fine wood floors, leaving small indentations in the lacquer polish. As a consequence, some venues, halls, old museums and the like prohibit the use of stiletto heels in their buildings. Also, heel covers, especially those made of fabric, can sustain serious damage when exposed to various elements such as water, snow, rain or puddles. Such damage may take place at an outdoor event, wedding, garden party and the like.

The present invention contemplates elimination of problems associated with conventional unprotected heels of shoes and provision of a shoe heel sleeve that can be selectively engaged with and disengaged from a heel of a shoe.

SUMMARY OF THE INVENTION

It is, therefore, an object of the invention to provide a shoe heel cover, or heel sleeve that can be placed on a heel and cover at least the bottom portion of the heel.

It is another object of the invention to provide a shoe heel cover configured to firmly engage the bottom portion of the heel.

It is a further object of the invention to provide a shoe heel cover that is aesthetically pleasing and easy to use.

These and other objects of the invention are achieved through a provision of a shoe heel cover designed to be selectively positioned and removed from a heel of a shoe. The heel cover is configured as a resilient flexible compressible hollow body having a plurality of concave indentations formed in its outer wall. A plurality of concave parts, each corresponding to the concave indentations extends inwardly toward the center of the opening formed in the hollow body. In one aspect, the heel cover body has an hour-glass cross-section. The middle portion of the body has the smallest diameter opening, such that the convex parts exert a bias and gripping action on the heel, preventing the heel cover from slipping from the shoe heel. An annular flange secured to the top edge of the body further secures the heel cover of the heel.

BRIEF DESCRIPTION OF THE DRAWINGS

Reference will now be made to the drawings, wherein like parts are designated by like numerals, and wherein.

DETAIL DESCRIPTION OF THE INVENTION

Figure 1:
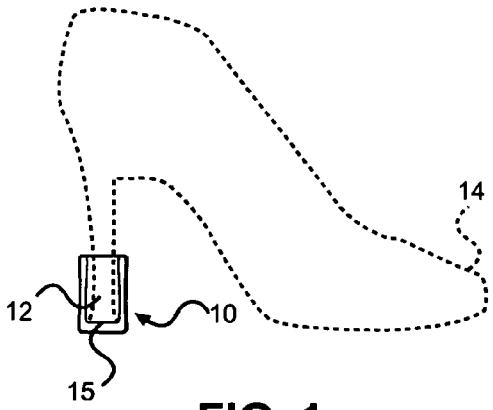
FIG. 1 is a plan view of the shoe heel cover of the first embodiment of the invention secured on a heel of a shoe.
Figure 2:
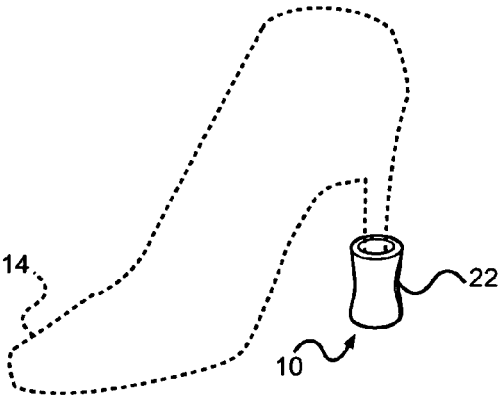
FIG. 2 is a perspective view of the shoe heel cover of the first embodiment secured on a heel of a shoe.
Figure 3:
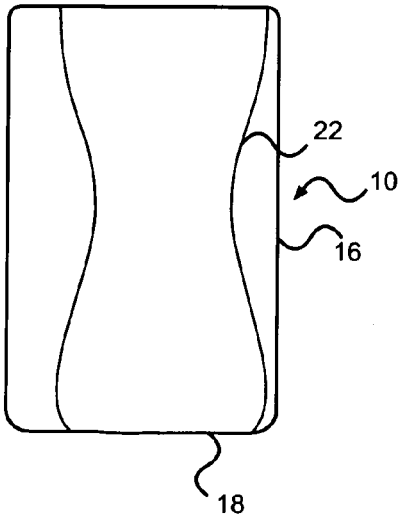
FIG. 3 is a side elevation of the shoe heel cover of the first embodiment.
Figure 4:
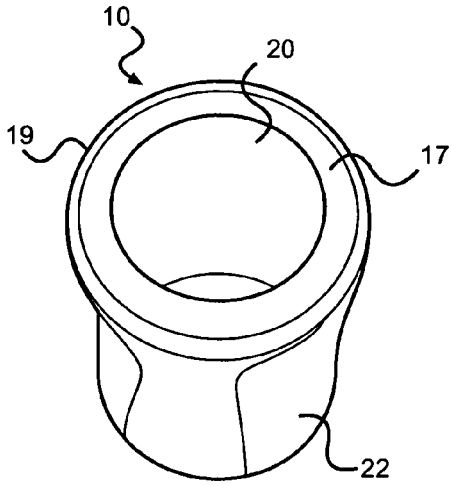
FIG. 4 is a perspective top view of the shoe heel cover of the first embodiment.
Figure 5:
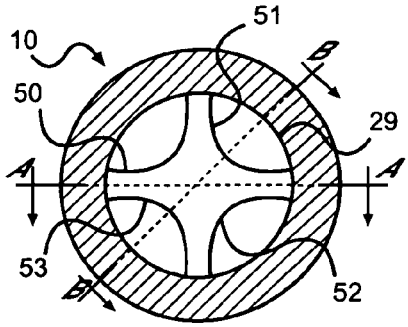
FIG. 5 is a cross-sectional view of the top portion of the shoe heel cover of the first embodiment.
Figure 8:
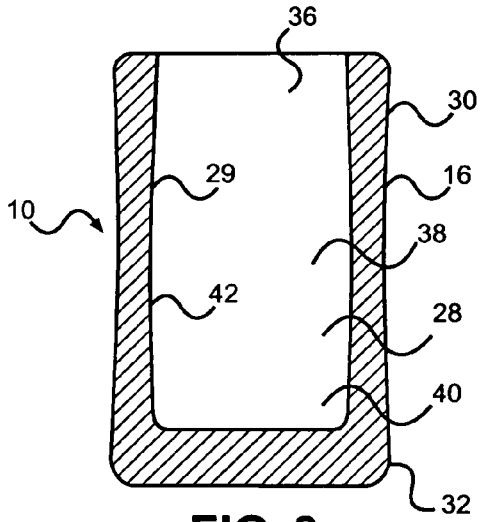
FIG. 8 is a longitudinal section of the shoe heel cover of the first embodiment, taken along lines A-A of FIG. 5.
Figure 6:
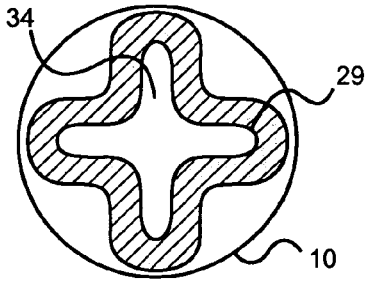
FIG. 6 is a cross-sectional view of the middle portion of the shoe heel cover of the first embodiment.
Figure 7:
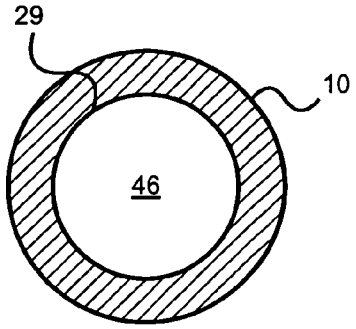
FIG. 7 is a cross-sectional view of the bottom portion of the shoe heel cover of the first embodiment.
Figure 9:
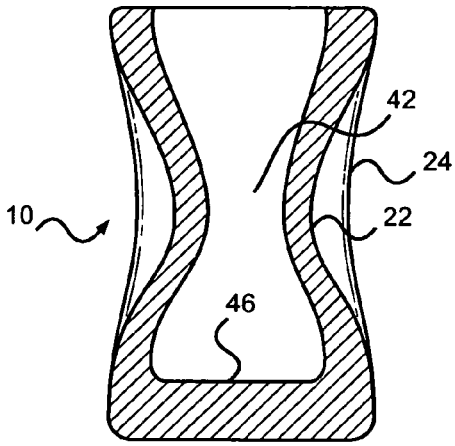
FIG. 9 is a longitudinal section of the shoe heel cover of the first embodiment, taken along lines B-B of FIG. 5.
Figure 10:
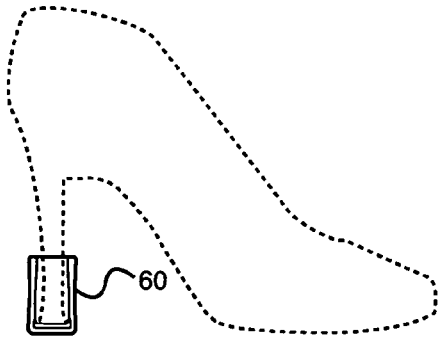
FIG. 10 is a plan view of the shoe heel cover of the second embodiment of the invention secured on a heel of a shoe.
Figure 11:
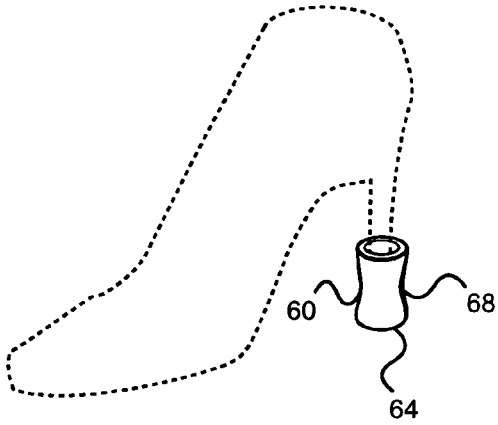
FIG. 11 is a perspective view of the shoe heel cover of the second embodiment secured on a heel of a shoe.
Figure 12:
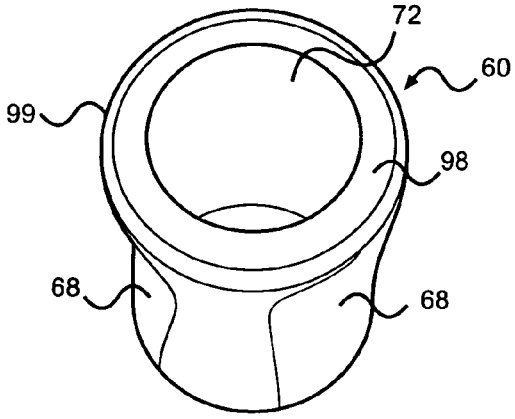
FIG. 12 is a perspective top view of the shoe heel cover of the second embodiment.
Figure 13:
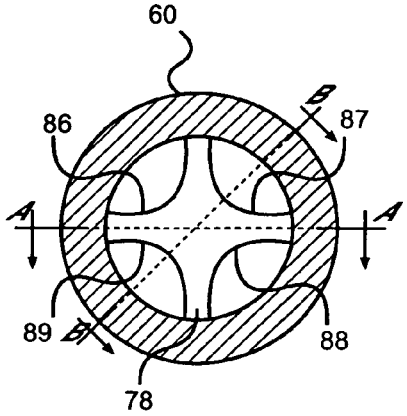
FIG. 13 is a cross-sectional view of the top portion of the shoe heel cover of the second embodiment.
Figure 16:
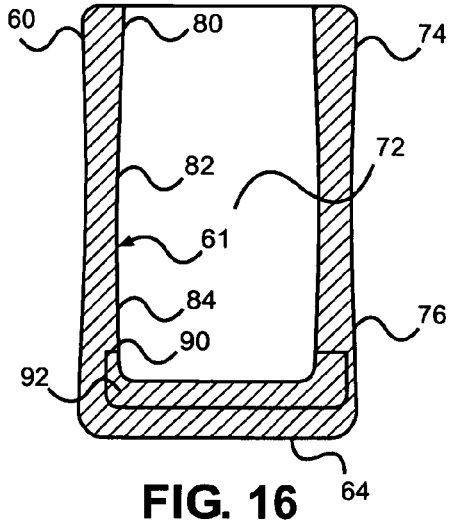
FIG. 16 is a longitudinal section of the shoe heel cover of the second embodiment, taken along lines A-A of FIG. 14.
Figure 14:
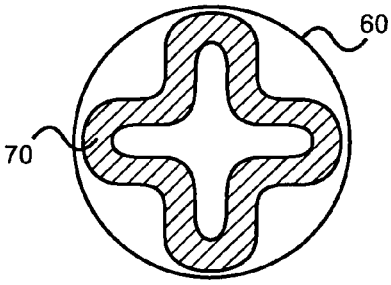
FIG. 14 is a cross-sectional view of the middle portion of the shoe heel cover of the second embodiment.
Figure 15:
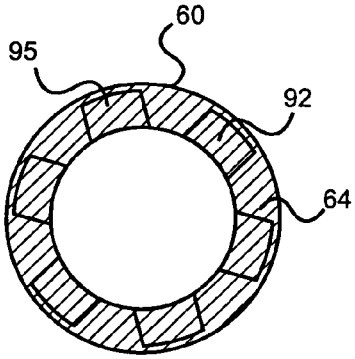
FIG. 15 is a cross-sectional view of the bottom portion of the shoe heel cover of the second embodiment.
Figure 17:
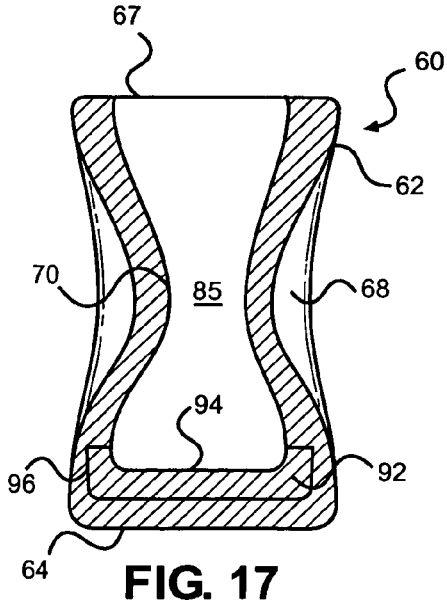
FIG. 17 is a longitudinal section of the shoe heel cover of the second embodiment, taken along lines B-B of FIG. 14.
Figure 18:
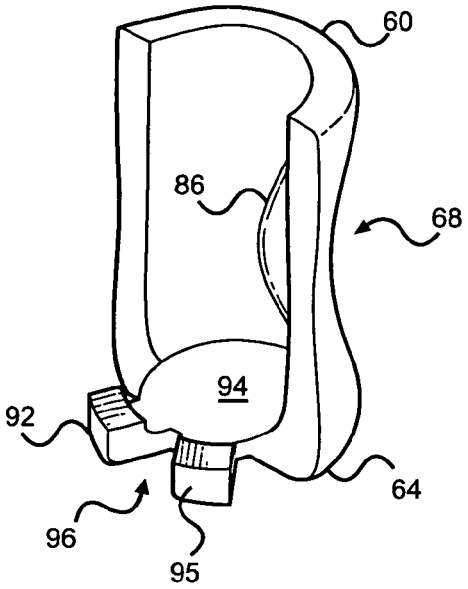
FIG. 18 is a partially cut-away view of the shoe heel cover of the second embodiment showing the base plate.
Figure 20:
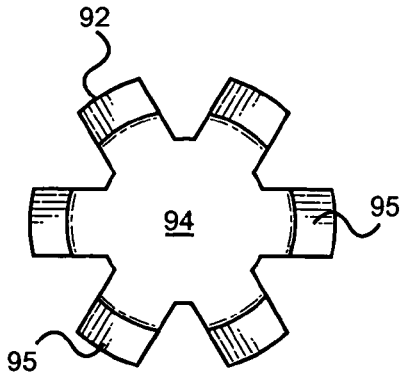
FIG. 20 is a top view of the base plate.
Figure 21:
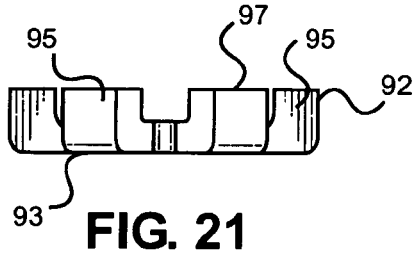
FIG. 21 is side view of the base plate.
Figure 19:
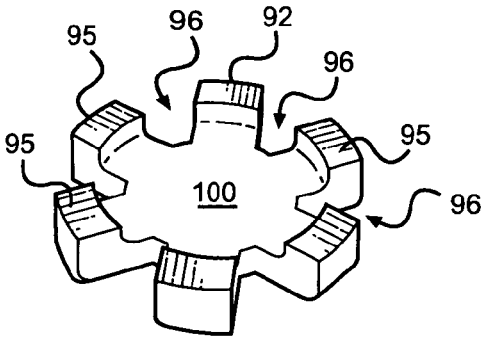
FIG. 19 is a perspective view of the base plate.
Figure 22:
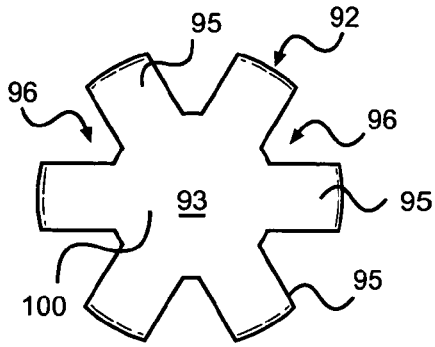
FIG. 22 is a bottom view of the base plate.

It should be noted that the drawings are not rendered to any particular scale or proportion. It is contemplated that any of the configurations and materials described hereafter can be modified within the scope of this invention.

Turning now to the drawings in more detail, numeral 10 designates a shoe heel cover of the first embodiment. As can be seen in FIGS. 1-9, the heel cover 10 is configured as a single piece that can be slipped onto a heel 12 of a shoe 14. The heel cover 10 is also easily removable from the heel 12 when not required. The heel cover 10 can be formed from a resilient flexible, strong and durable material, such as for instance of polypropylene or some other suitable material. In one aspect, the material of the heel cover is transparent. In other embodiments, the heel cover 10 can be formed from a color-infused material to match the shoe color. The heel cover 10 can be manufactured by injection molding or other suitable process.

The heel cover 10 comprises a hollow body 16 having a closed bottom 18 and an open top 20. The heel cover 10 has an exterior surface configured to have several inwardly concave indentations 22. The indentations 22 are equidistantly spaced about a circumference of the exterior surface of the heel cover 10. In one exemplary embodiment, the heel cover 10 is provided with four symmetrical indentations. In a perspective elevation of FIG. 2, the heel cover 10 resembles an hour glass, with a reduced diameter middle portion 24.

The body 16 of the heel cover 10 defines a central opening 28, which extends from a top portion 30 to a bottom portion 32. The central opening 28 is restricted and forms a cross-shaped channel 34, which extends through substantially entire middle portion 24.

The inner wall 29 of the heel cover, which defines the central opening 28, has three distinct regions: a top region 36, a middle region 38, and a bottom region 40. In the areas between the top region 36 and middle region 38, and the bottom region 40 and the middle region 38, the inner diameter gradually decreases along an arcuate surface. The middle region 38 contains the smallest diameter part 42.

In the exemplary embodiment shown in the drawings, the inner wall 29 has four distinct convex members 50, 51, 52, and 53, which are directly opposite to the indentations 22 formed in the body of the heel cover 10. Each of the convex members 50, 51, 52, and 53 has a largest radius section, said section being located in the middle portion of the hollow body 16.

The inner wall that defines the central opening 28 is curved, as shown in FIGS. 5-9, so that a heel 12, when guided into the heel cover 10 passes through the top portion 30 and then through the middle portion 24 is frictionally engaged by the curved inner wall in the middle region 38. The diameter of the part 42 is selected to apply a bias and clamp action on the heel 12, thereby preventing the heel 12 from disengaging from the heel cover 10.

To further ensure secure engagement of the heel cover 10 with the heel 12, the heel cover 10 is provided with an inwardly extending annular flange 17 that is unitary connected to a top edge 19 of the heel cover 10 and extends toward the center of the opening 20 transversely to a longitudinal axis of the hollow body 16. The flange 17 is preferably formed from a soft, resilient flexible material that will protect the heel 12 from damage, while also engaging and guiding the heel while the heel cover is being positioned thereon.

As can be seen in FIG. 1, the top lift 15 of the heel 12 rests on the bottom surface 46 of the heel cover 10, while the curved parts 50, 51, 52, and 53 firmly engage the heel 12. Since the heel cover is formed from a flexible resilient material, the heel cover 10 can be easily removed from the heel 12 if not required.

In one aspect, the longitudinal dimensions of the heel cover 10 are about 1 inch, with the bottom wall being about 0.1875". Of course, other sizes can be chosen during manufacturing process of the heel cover 10.

Turning now to the second embodiment shown in FIGS. 10-22, the heel cover 60 is shown in detail. In this embodiment, the heel cover 60 is configured as a single piece that can be slipped onto a heel 12 of a shoe 14. The heel cover 60 is also easily removable from the heel 12 when not required. The heel cover 60, similar to the heel cover 10 can be formed from a soft, resilient flexible, strong and durable material, such as for instance of polypropylene or some other suitable material. In one aspect, the material of the heel cover 60 is transparent. In other embodiments, the heel cover 60 can be formed from a color-infused material to match the shoe color. Similar to the heel cover 10, the heel cover 60 can be manufactured by injection molding or other suitable process.

The heel cover 60 comprises a hollow body 62 having a closed bottom 64 and an open top 67. The heel cover 60 has an exterior surface configured to have several inwardly concave indentations 68. In the exemplary embodiment shown in FIGS. 10-22, the heel cover 60 has four identical indentations 68. The indentations 68 are equidistantly spaced about a circumference of the exterior surface of the heel cover 60. In a longitudinal section of FIG. 17, the heel cover 60 is shown resembling an hour glass, with a reduced diameter middle portion 70.

The body 62 of the heel cover 60 defines a central opening 72, which extends from a top portion 74 to a bottom portion 76. The central opening 72 is restricted and forms a cross-shaped channel 78, which extends through substantially entire middle portion 70.

An inner wall 61 of the heel cover, which defines the central opening 72, has three distinct regions: a top region 80, a middle region 82, and a bottom region 84. In the areas between the top region 80 and the middle region 82, and the bottom region 84 and the middle region 82, the inner diameter gradually decreases along several arcuate surfaces. The middle region 82 contains the smallest diameter part 85.

In the exemplary embodiment of FIGS. 10-22, the inner 61 has four distinct convex parts 86, 87, 88, and 89, which are directly opposite to the indentations 68 formed in the body of the heel cover 60. Each of the convex members 86, 87, 88, and 89 has a largest radius section, said section being located in the middle portion of the hollow body 62.

The inner wall 61 that defines the central opening 72 is curved, so that the heel 12, when guided into the heel cover 60 passes through the top portion 80 and then through the middle portion 70 is frictionally engaged by the curved inner wall 61 in the middle region 82. The diameter of the smallest diameter part 85 is selected to apply a squeezing force on the heel 12, thereby preventing the heel 12 from disengaging from the heel cover 60.

The bottom portion 76 is provided with a cutout 90, which has a generally U-shaped configuration in cross-section. The cutout 90 extends through a portion of the wall thickness; the cutout 90 defines an annular channel, into which a base plate 92 is fitted. The base plate 92 may be glued, fused, or secured within the cutout by other suitable means. In one aspect, the base plate if formed from a thermoplastic material.

The base plate 92 is configured as a unitary body having a substantially planar base 100 with a bottom surface 93 and a top surface 94 and a peripheral edge. A plurality of upwardly curving projections 95 extend from the peripheral edge of the planar base, from the bottom surface 93 above the top surface 94. The projections 95 fit into the cutouts formed in the sidewall 96 without extending beyond the periphery of the sidewall 96 either in the interior or exterior of the body 62.

In the exemplary embodiment of the heel cover 60, there are six projections 95. The projections 95 are spaced from each other by slots 96. The projections 95 have less thickness than the thickness of the sidewall 96. In one aspect, the height of each projection 95, from the bottom surface 93 to a top edge 97 is about 0.125", while the diameter of the base plate at the top is about 0.583". The thickness of the base plate, from the bottom surface 93 to the top surface 94 is about 0.625". In one aspect, the distance between the bottom 64 of the body 62 and the top edge of the projections 95 is about 0.1875". Of course, other dimensions and configurations can be selected if desired.

When the base plate 92 is used the thickness of the bottom wall of the heel cover 60 is increased, providing more cushioning for the heel 12. To further ensure secure engagement of the heel cover 60 with the heel 12, the heel cover 60 can be provided with an inwardly extending annular flange 98 that is unitary connected to a top edge 99 of the heel cover 60 and extends toward the center of the opening 72 transversely to a longitudinal axis of the body 62. The flange is preferably formed from a soft, resilient flexible material that will protect the heel 12 from damage, while also engaging and guiding the heel while the heel cover is being positioned thereon.

The resilient nature of the material from which the heel covers 10 and 60 are constructed allows the inner convex portions to bias the heel 12 against the interior surfaces of the heel covers 10, 60 so that the heel covers 10 or 60 are retained on the heel 12.

The heel covers 10 and 60 may be used multiple times on multiple different shoes without changing the fit of any of the shoes on which heel covers of the instant invention are worn. However, individual users may desire to maintain one set of heel covers with a particular pair of shoes, particularly if the heel cover is selected to match the shoe color and shoe design.

Many changes and modifications can be made in the design of the present invention without departing from the spirit thereof. I, therefore, pray that my rights to the present invention be limited only by the scope of the appended claims.

I claim:

1. A shoe heel cover device, comprising:

a hollow body configured for selective positioning on a heel of a shoe, said hollow body comprising a sidewall, closed bottom, and open top, said sidewall having an inner surface and an outer surface, said sidewall is provided with a plurality of concave indentations formed in the outer surface, each of said concave indentations being aligned with a convex member; and a plurality of convex members extending from the inner surface toward a center of the hollow body, said convex members being configured to exert bias and gripping action on the heel of the shoe positioned inside the hollow body.

2. A shoe heel cover device, comprising:

a hollow body configured for selective positioning on a heel of a shoe, said hollow body comprising a sidewall, closed bottom, an open top, and a bottom plate, said sidewall having an inner surface and an outer surface, and wherein a cutout is formed in said bottom plate and said sidewall inside said hollow body, said base plate comprises a unitary body having a planar base and a plurality of projections extending upwardly from a peripheral edge of the planar base; and a plurality of convex members extending from the inner surface toward a center of the hollow body, said convex members being configured to exert bias and gripping action on the heel of the shoe positioned inside the hollow body.

3. The device of claim 2, wherein said projections are equidistantly spaced about periphery of the planar base.

4. The device of claim 2, wherein a channel is formed between a pair of adjacent projections.

5. A shoe heel cover device, comprising:

a resilient flexible compressible hollow body configured for selective positioning on a heel of a shoe, said hollow body comprising a sidewall, closed bottom, and open top; said sidewall having an inner surface and an outer surface, said outer surface being provided with a plurality of concave indentations; and a plurality of convex members extending from the inner surface toward a center of the hollow body, said convex members being aligned with the concave indentations, said convex members being configured to exert bias and gripping action on the heel of the shoe positioned inside the hollow body.

6. The device of claim 5, wherein said hollow body comprises an hour-glass cross-section.

7. The device of claim 5, wherein said hollow body comprises a top portion with a top edge, a middle portion and a bottom portion, and wherein said convex members extend between the top portion and the bottom portion.

8. The device of claim 5, further comprising an annular flange secured to the top edge of the top portion, said flange extending inwardly in a transverse relationship to a longitudinal axis of the hollow body.

9. The device of claim 8, wherein an opening is formed is said hollow body, said opening extending from the top to the bottom of the hollow body.

10. The device of claim 9, wherein said opening has a generally cross-shaped cross-section in the middle portion of the hollow body.

11. The device of claim 5, wherein said hollow body comprises a bottom plate, and wherein a cutout is formed in said bottom plate and said sidewall inside said hollow body.

12. The device of claim 11, wherein a base plate is fitted into said cutout.

13. The device of claim 12, wherein said base plate comprises a unitary body having a planar base and a plurality of projections extending upwardly from a peripheral edge of the planar base.

14. The device of claim 13, wherein said projections are equidistantly spaced about periphery of the planar base.

15. The device of claim 13, wherein a channel is formed between a pair of adjacent projections.

16. The device of claim 11, wherein said base plate is formed from a thermoplastic material.

* * * * *